United States Patent [19]

Keeton

[11] 4,004,391

[45] Jan. 25, 1977

[54] METHOD AND A PANEL FOR PRE-FABRICATING BUILDINGS

[76] Inventor: John Herbert Keeton, P.O. Box 278, Taylor Blvd., Campbellsville, Ky. 42718

[22] Filed: Oct. 30, 1974

[21] Appl. No.: 519,191

Related U.S. Application Data

[60] Continuation of Ser. No. 331,708, Feb. 12, 1973, abandoned, Division of Ser. No. 127,202, Mar. 23, 1971, abandoned.

[52] U.S. Cl. ..... 52/584; 52/591; 52/594

[51] Int. Cl.[2] ..... E04C 1/10; E04C 1/30

[58] Field of Search ..... 52/581, 582, 481, 578, 52/584, 480, 754, 755, 753 C, 753 K, 591, 594, 593, 756; 248/224

[56] References Cited

UNITED STATES PATENTS

| | | | |
|---|---|---|---|
| 2,076,728 | 4/1937 | Keller | 52/584 X |
| 2,104,550 | 1/1938 | Bates | 52/578 X |
| 2,633,610 | 2/1953 | Hervey | 52/584 X |
| 2,682,938 | 7/1954 | MacDonald | 52/591 |
| 2,732,044 | 1/1956 | McClune | 52/578 X |
| 2,817,551 | 12/1957 | Gieleghem | 292/302 X |
| 2,863,690 | 12/1958 | Lewin | 292/302 |
| 2,967,335 | 1/1961 | Zitomer | 292/302 |
| 2,970,677 | 2/1961 | Springs et al. | 52/584 X |
| 3,229,334 | 1/1966 | Thome | 52/584 X |
| 3,332,182 | 7/1967 | Mark | 52/584 X |
| 3,357,146 | 12/1967 | Gartrell | 52/593 X |
| 3,392,497 | 7/1968 | Cushman | 52/584 X |
| 3,439,812 | 4/1969 | Nagelkirk et al. | 52/754 X |
| 3,511,000 | 5/1970 | Keuls | 52/594 X |
| 3,529,860 | 9/1970 | Jelley | 52/584 X |
| 3,626,652 | 12/1971 | Hanley | 52/584 |
| 3,684,228 | 8/1972 | Sobel | 248/224 X |
| 3,731,956 | 5/1973 | Hanley | 52/753 C |

FOREIGN PATENTS OR APPLICATIONS

| | | | |
|---|---|---|---|
| 253,753 | 4/1967 | Australia | 52/584 |
| 1,063,713 | 3/1967 | United Kingdom | 248/224 |

*Primary Examiner*—Ernest R. Purser
*Assistant Examiner*—Leslie A. Braun
*Attorney, Agent, or Firm*—Cushman, Darby & Cushman

[57] ABSTRACT

A prefabricated building made from rectangular panels which interlock on at least two edges by means of a stud and sliding eyelet arrangement so that each panel can be positively interlocked at each of its edges. The panels, which form the ceiling, floor and outer walls of the building, are each three feet wide and all the panels have an equal depth. The panels may be filled with an insulating foam, and their interlocking edges may be sealed by vinyl strips.

A pitched roof is also fabricated from three foot wide panels having the same depth as the panels above. The roof panels interlock with the wall panels with which they overlap to provide a more secure locking of the wall panels and an end overlap for the roof.

4 Claims, 13 Drawing Figures

29
31
13
33
15
21
19
27
45
17
25
23

Fig. 10
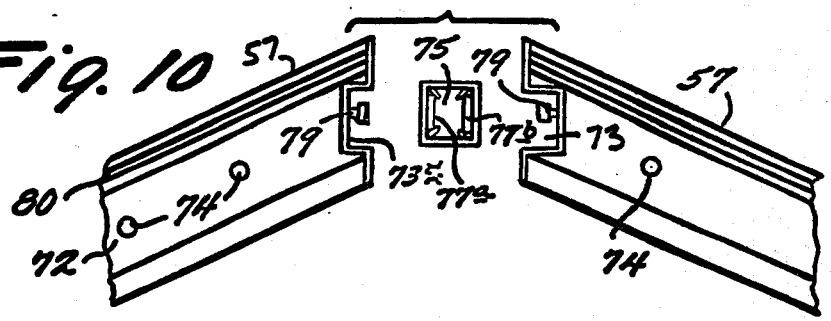
Fig. 11
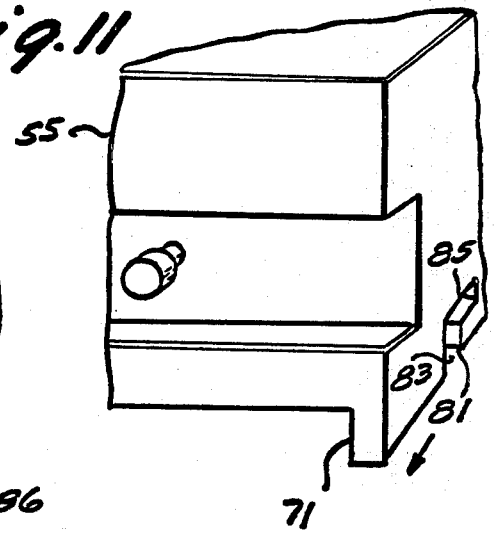
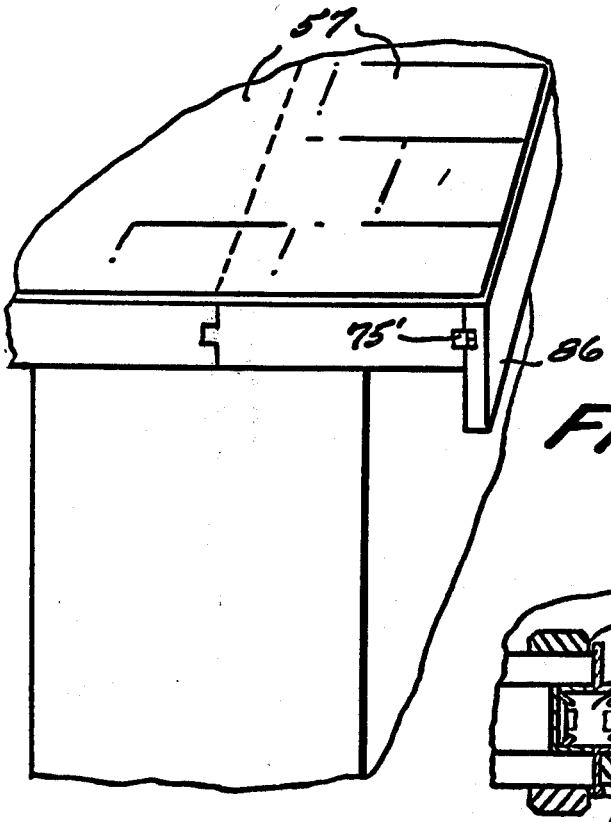
Fig. 12
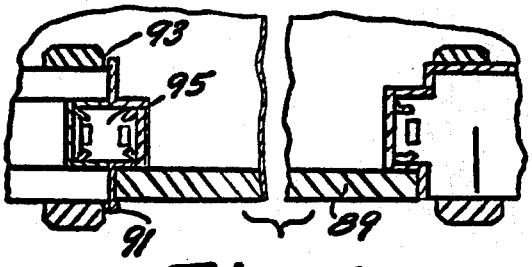
Fig. 13

METHOD AND A PANEL FOR PRE-FABRICATING BUILDINGS

This is a continuation of application Ser. No. 331,708, filed on Feb. 12, 1973, now abandoned, as a divisional application of Ser. No. 127,202, filed on Mar. 23, 1971, now abandoned.

DISCLOSURE OF THE INVENTION

Field of the Invention

The field of prefabricated building construction is already a crowded art. Yet mass production of homes and other buildings has not become a reality. Further, a securely interlocked house which is easily assembled by a few untrained men has yet to be produced.

More specifically, one disadvantage of known panels from which prefabricated buildings are constructed has been that they cannot be locked at all four edges and thus they cannot be securely interlocked.

Another problem with respect to the manufacture of panels has been that different sized panels were required for the roof, ceilings, floors and walls which, of course, increased the manufacturing costs for the house as a whole.

Another problem also encountered by the prior art was how to give prefabricated houses a traditional pitched roof configuration without resorting to traditional roofing construction methods which would, of course, offset the advantages of prefabricated construction.

Further, it has been known that three foot wide panels would be advantageous for design purposes. For example, the use of a three foot wide panel would permit a brick facing to be placed upon the panels with each panel being exactly four standard 8 inch long bricks wide. However, since some housing codes often required doors and windows to have a standard three foot width (which is actually slightly narrower than three feet) and the prior art could not put a three foot window in a three foot panel, the prior art could not produce a three foot panel.

SUMMARY OF THE INVENTION

In view of the disadvantages described above with respect to the prior art, this invention provides an improved locking device for a panel used in prefabricated construction which allows each panel to be interlocked at each of its four edges. The device includes a stud having an enlarged head which protrudes from at least one edge of the panel. The enlarged head fits into the larger end of an eyelet located on an element which is mounted to slide rectilinearly with respect to the edge of an adjacent panel. The sliding element can be moved after two panels are placed in an edge-to-edge relationship.

When sliding of the element is effected, the narrower portion of the keyhole then separates the enlarged head from the rest of the stud to interlock the panels. This special interlocking feature allows the panels to be slidably locked at one or both ends and then locked to each other at their other edges. To further guide the edge to edge connection of the panels, the stud and the sliding element are mounted on a mating tongue and groove, respectively, on the edges of the panels.

Another feature included in the invention is that all of the panels used in the roof, ceiling, walls and floor of the building have the same width and depth which, of course, reduces the material and manufacturing costs which would be required by a variety of panel sizes. Furthermore, a panel width of three feet can be accomplished even in panels holding doors by inserting a channel [having a stud interlocking means on one side and eyelet interlocking means on the other] in the groove of the panel which holds the doors. The channel and the tongue of the adjacent panel form door stops on the opposite edges of the doors.

A further feature of the invention is in the method of placing the roof on the walls; the roof panels are overlapped with the wall panels to further lock the wall panels together and to produce a traditional overhang at the ends of the roof.

Other features of the invention will become more obvious in view of the detailed description of the preferred embodiment and the drawings which follow.

BRIEF DESCRIPTION OF THE DRAWINGS

FIG. 10 is an exploded end view showing the manner in which the roof panels are interlocked with each other;

FIG. 11 is a perspective view of a portion of the ceiling panel shown in FIG. 9 showing the means by which the ceiling and floor panels are interconnected with the walls panels, respectively;

FIG. 12 is a detailed view showing how the roof panels are interconnected with the wall panels and the facia; and FIG. 13 is a top sectional view along the center line showing a door panel in accord with the invention.

DETAILED DESCRIPTION OF THE PREFERRED EMBODIMENT

Figures 1, 2, 3, 4, 5:
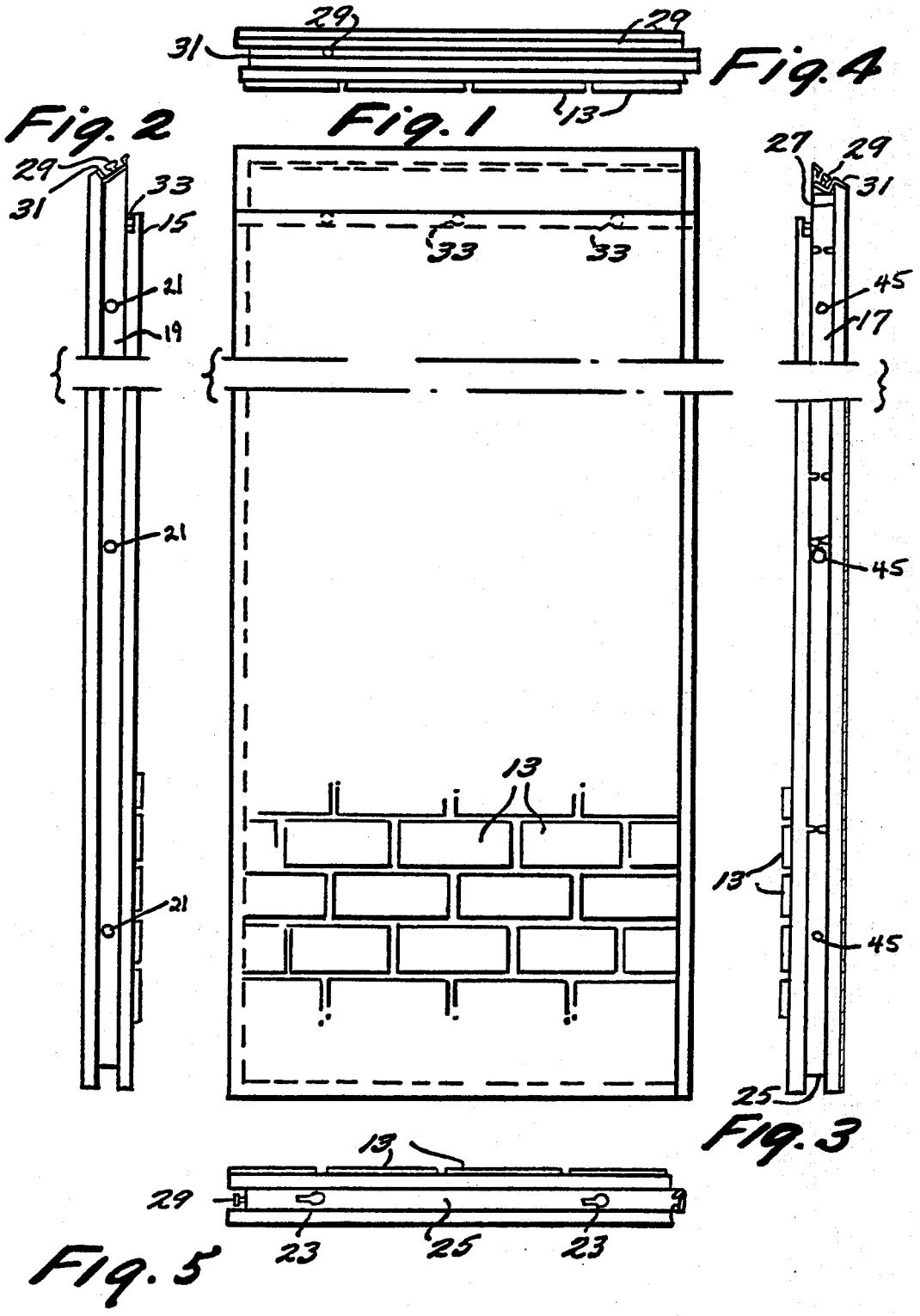
FIG. 1 is a front view of a panel for the preferred embodiment of the invention.
FIG. 2 is a left-hand view of the panel shown in FIG. 1.
FIG. 3 is a right-hand view of the panel shown in FIG. 1.
FIG. 4 is a top view of the panel shown in FIG. 1.
FIG. 5 is a bottom view of the panel shown in FIG. 1.

FIGS. 1 through 5 show the front view of a wall panel in accordance with the invention and edge views of the top, bottom and sides of the panel. The panel, itself, which is designated by the reference numeral 12, has a width of three feet, which is a highly advantageous dimension for use in building design. For instance, this permits the outward face of the panel 12 to receive exactly four 8 inch long bricks, which are indicated by reference numeral 13, which, thus, makes for a pleasing and uniform external appearance.

The height of the panel 12 depends on the height of the particular level of construction desired. In a preferred embodiment, the height from the bottom of the panel to the building 15 should be approximately ten feet. The depth of the panel does not form a part of the invention per se and is not a critical dimension so long as it provides room for the engaging and interlocking devices, which will be presently described.

As best shown in FIGS. 1, 4 and 5, the panel has a right-hand tongue protrusion 17 and a left-hand groove 19. The tongue 17 extends the full height of the panel, while the groove 19 extends from the bottom of the panel to the area of lip 15.

The groove 19 is dimensioned to receive a tongue identical to tongue 17 so that when a plurality of panels 12 are assembled in edge to edge relationship, the tongues and grooves help to form a solid wall. While these dimensions are not essential to the invention, the tongue's width may be about one-half and the groove's depth would then also be approximately one-half inch.

Figure 8:
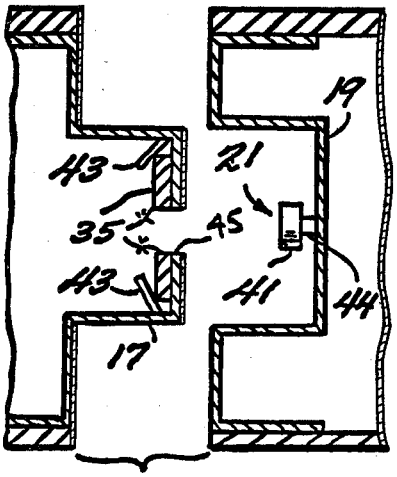
FIG. 8 is an exploded top view taken along the center line of adjacent panels showing the relative position of the tongue, groove and interlocking means.
Figure 7:
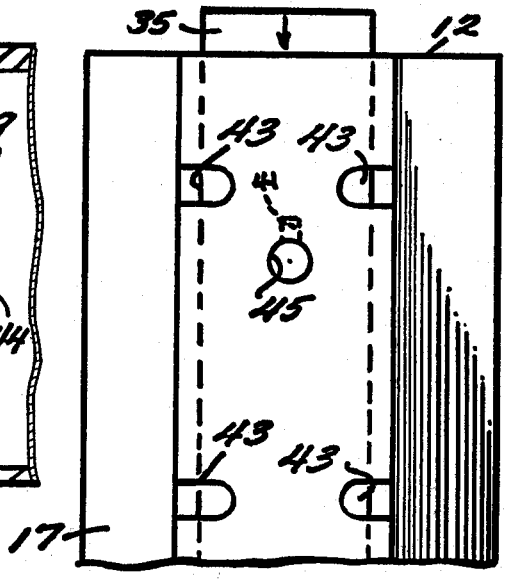
FIG. 7 is a fragmentary view showing the sliding member interconnected with the tongue of the panel.
Figure 6:
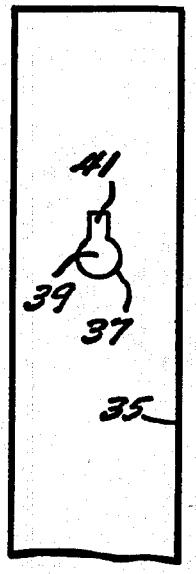
FIG. 6 is a front view of a sliding member used in this invention.

Besides the tongues and grooves, the panels are interlocked to adjacent panels by means of a stud and eyelet arrangement as best shown in FIGS. 6, 7 and 8 and described below. For purposes of this discussion, it is sufficient to note that a plurality of studs 21 protrude from grooves 19 along the center line of the groove and perpendicularly to the center line. In addition, a plurality of keyholes are formed on the sliding panel 27 shown in FIG. 3 along the right edge of the panel, which are positioned and sized to receive studs 21 from an adjacent panel and, therefore, to interlock the panels. Also, the studs 29 are shown protruding from the groove 31 in the top of the panel which is disposed at an angle with respect to the lip 15, which is equal to the pitch of the roof, while the stud 29 protrudes perpendicularly from the groove 31. In addition, a plurality of keyhole-shaped eyelets 23 lie along the center line of the groove 25 formed in the bottom of the panel.

Finally, the lip 15 contains at least one pin 33, for locking the ceiling panels in a method more fully described and shown below.

Thus, it is seen that the panel 12, due to the novel construction of the interlocking means, can be locked at each of its four edges to other adjacent panels, and, therefore, a highly integrated and rigid multipanel structure can be created.

Turning now to FIG. 6, a sliding panel 35 is shown, which has a plurality of eyelets 37 having large portions 39 and smaller portions 41. The sliding panel 35 is disposed in the tongue 17 of a wall panel as is best shown in FIGS. 7 and 8, by a plurality of tabs 43 which are punched out of a tongue 17 to slidably support the sliding member 35 parallel to the face of tongue 17. Also, as shown in FIG. 7, the end of the sliding member 35 protrudes above the end of the panel 12 and, thus, the member 35 can be manipulated even when panel 12 is in engagement with an adjacent panel.

When the sliding member 35 is in the unlocked position with the end of the member protruding, the large part of the eyelets 39 are in complete register with the holes 45, which have been punched in the face of the tongue 17. The holes 45 and 39 are, moreover, of equal diameter. Turning now to FIG. 8, it is seen that the stud 21 consists of an enlarged head 41 and a relatively narrow neck 44. The enlarged head is so positioned and sized that it fits through the holes 39 and 45, when two adjacent panels 12 are moved into edge to edge engagement.

After the panels have been placed in edge to edge relationship with the studs protruding through adjacent eyelets, the sliding member 35 is then forced down in the direction of the arrow shown in FIG. 7 by force exerted upon its protruding end and this action interpositions the smaller portion 41 of the eyelet 37 between the head 41 of the stud 21 and the groove 19 from which stud 21 protrudes, thus, effectively locking the two adjacent panels together. The sliding member 35, thus, allows two adjacent panels 12 to be interlocked with a relative movement between the panels per se. Therefore, it is possible to first position the two adjacent panels 12 and lock them at their bottoms and then to move sliding member 35 to lock them at their adjacent edges. In the prior art, the panels could not be locked both at their bottom edges and at their side edges, and, therefore, the prior art structures provide less rigidity than does the present invention.

Figure 9:
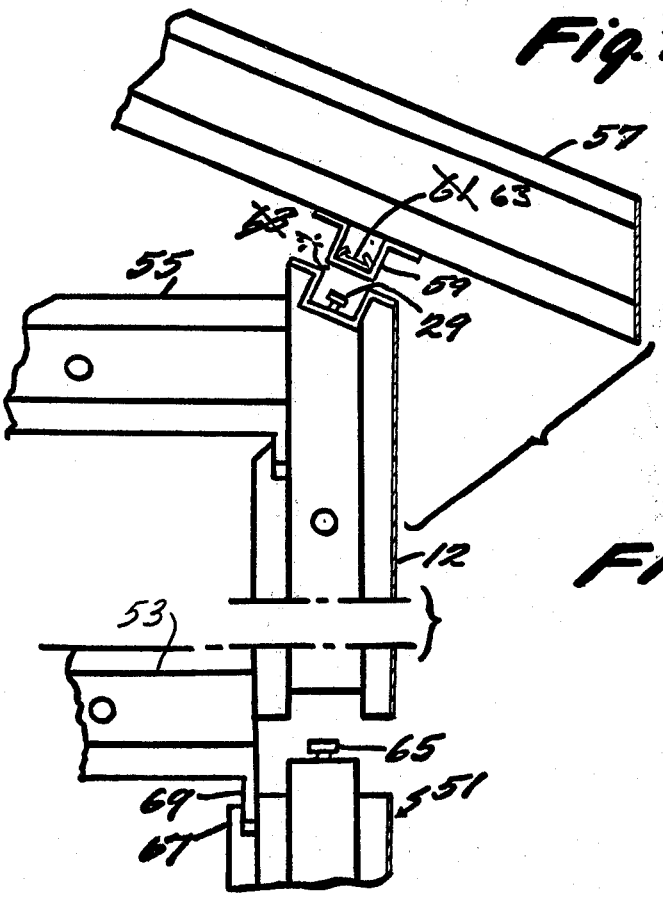
FIG. 9 is an exploded view of the portion of the building constructed from the panels shown above wherein the roof panel and support channel are shown in section and the other panels shown in full.

In FIG. 9, a left end view of a wall panel similar to FIG. 2 is shown in which the interconnecting means between the wall panel and foundation channel 51, the floor panels 53, the ceiling panels 55 and the roof panels 57 are shown in an exploded view. Basically, the roof panels each contain a tongue 59 which is angled and dimensioned to meet with the upper groove 31 of the wall panel. The tongue 59 contains a sliding member identical in design and operation to the member 35, and thus, the roof panels 57 are interlocked with the wall panels 12 by inserting studs 29 into holes in tongue 59 and then sliding member 63 with respect to groove 59.

In assemblying a house from the panels described above, the wall panels 12 are first mated with the channel member 51 by aligning the eyelets 23 which appear in the groove 25 at the bottom of the panel 12 with the studs 65 which protrude from the channel and are positioned and sized to register with the eyelets. The panels 12 are then moved parallel to the channel 51 to introduce the small portion of the eyelets 23 between the heads of the studs 65 and the channels 51. Next, the panels 12 are interlocked to each other as described above.

The floor panels 53 which have identical width and depth to panels 12 are then locked with respect to lip 67 of foundation 51 by engaging rim 69 which protrudes downwardly from each floor panel into a groove portion of lip 67 and locking each panel 53 by a sliding motion described in more detail with relation to FIG. 11 below.

An identical method is used to lock the ceiling panels 55, which have also the same depth and width as the wall panels 12 as was used to lock the panels 53. In other words, the rim 71 which protrudes downwardly from ceiling panels 55 is placed in register with the lip 15 of the wall panels 12. It is thus seen that a completely interlocking system is provided whereby the ceiling, walls, floor and roof panels are locked to one another and each edge of the respective panels is in locked contact with an adjacent panel.

FIG. 10 shows means whereby the roof panels 57 are interlocked at their free edges to each other. This exploded view shows that each of the roof panels 57 has groove 73 set at such an angle with respect to the edge of the panel as to be perpendicular to the ground. The grooves 73 interlock with a channel 75 which, if the grooves 73 are each one-half inch deep and one inch wide form a one inch square. The channel 75 has two sliding members 77*a* and 77*b* while studs 79 protrude from each of the groove 73. In assemblying the roof, the studs 79 register with the eyelets on the sliding members 73*a* and 73*b* and then the sliding members are driven by external force to interlock the roof panels.

It is noted that the roof panels are locked at their other sides in a manner identical to that described above with respect to the wall panels and to this effect studs 74 project from the grooves 72 at the edges of the panels 57.

It is also noted that the vinyl strips 80 are placed parallel to the edges of roof panels 57 to seal the panel edges when the roof has been interlocked. Vinyl strips of this nature may also be used between the wall panels and even the ceiling and floor panels if found necessary.

FIG. 11 shows a perspective view of the ceiling panel 55 having a lip 71 and an L-shaped aperture 81 having a generally vertical section 83 and a generally horizontal section 85. In locking a ceiling panel 55 to a wall panel 12, the generally vertical portion 83 is inserted over the pin 33 within the lip 15 of the wall panel and then the ceiling panel 55 is slided in the direction of the arrow in FIG. 11 to engage the horizontal portion 85 with the pin 33. Although not shown, the floor panels interlock with the channels 51 in an identical manner.

FIG. 12 shows that the roof panels 57 are overlapped with respect to the wall panels 12 so that a traditional overhang is provided at the edge of the house, and, in addition, the wall structure is even more solidly interconnected because each panel interlocks to two adjacent wall panels and each wall panel interlocks to two adjacent roof panels. FIG. 12 also shows that 75', a channel similar to channel 75 may be utilized so that only one type of facia 86 is required for both ends of the roof. In other words, a facia having a groove and studs centered therein would naturally meet with the tongue at one end of the roof panel, while a channel inserted in and protruding from the groove at the other end of the roof panels would provide a similar tongue interconnection for the facia.

The channels shown above are also used in connection with the door containing panels such as shown in sectional view in FIG. 13. In this figure, the door 89 which is a commercially available one, slightly less than three feet wide, is hinged at point 91 to the frame 93, which has a grooved projection which mates with the channel 95. The channel 95 is identical in operation, size and design to channel 75 as shown above. It is utilized to provide one of the two door stops in the frame. The other door stop is provided by the tongue extending from an adjacent panel 12 which, in turn, mates with the other grooved portion of the frame 93. Both of the frame edges 93 have studs 94 protruding therefrom which mate with the eyelets on channel 95 and tongue 17.

While the above figures and the description with respect thereto illustrate the preferred embodiment of this invention, it should be obvious to one skilled in the art that many modifications are possible within the scope of the invention. For example, the panels may be hollow, or may be filled with an insulating and additionally supporting medium such as urethane foam. In addition, it is possible to replace the lip and rim interlocking means between the side panels and the ceiling and between the floor panels and the channel with stud eyelet sections similar to studs 65 and eyelets 23 used to lock the bottom of panel 12 to channel 51. Also, a variety of facings may be utilized on either or both sides of the panel 12 so that an individual appearance may be given to the interior and exterior of the prefabricated house.

What is claimed is:

1. A building panel for constructing building walls and the like comprising a. a first side edge comprising an elongated wall adapted to cooperate with an elongated wall of a second side edge of a like building panel, b. a second side edge, opposite said first side edge, comprising an elongated wall adapted to cooperate with an elongated wall of a first side edge of a like building panel, c. a tongue protrusion extending substantially along the length of said elongated wall of said first side edge, and having a plurality of spaced apart apertures disposed therein, d. a groove extending substantially along the length of said elongated wall of said second side edge, and having a plurality of spaced projections formed on the surface thereof for cooperation with apertures in a tongue protrusion of a like building panel, and e. locking means carried by said tongue protrusion for engaging projections of a like building panel when the latter are inserted into said apertures in said tongue protrusion and for preventing withdrawal of the projections from the apertures, said locking means comprising an elongated substantially flat slide member extending along the length of said tongue protrusion and in slidable engagement therewith, said slide member having keyhole-shaped apertures therethrough disposed opposite the apertures in said tongue protrusion, said keyhole-shaped apertures having portions of enlarged area about equal to the area of the apertures, said slide member being movable longitudinally from a first position in which the projections of a like panel may pass through said apertures to a second position in locking engagement with the projections of a like panel, said slide member having an end which extends beyond the end of said elongated wall of said first side edge so as to be accessible for actuation after tongue and groove engagement of said first side edge with a second side edge of a like panel.

2. A panel as in claim 1 wherein punched-out tabs integral with said tongue protrusion retain said slide member in slidable engagement with said tongue protrusion.

3. A panel as in claim 1 including third and fourth mutually parallel edges connecting said first and second edges, said third edge having keyhole-shaped apertures spaced-apart along said third edge, said fourth edge having parallel projections extending therefrom at spaced-apart locations along its length.

4. A panel as in claim 3 wherein the projections extending from said fourth edge are inclined with respect to the plane of the panel.

* * * * *